US007828182B2

(12) United States Patent
Lin et al.

(10) Patent No.: US 7,828,182 B2
(45) Date of Patent: Nov. 9, 2010

(54) STAPLER SWITCHABLE BETWEEN VARIOUS OPERATION MODES AND SWITCHING METHOD THEREOF

(75) Inventors: Yi-wei Lin, Taipei (TW); Yi-ru Chen, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 258 days.

(21) Appl. No.: 12/044,198

(22) Filed: Mar. 7, 2008

(65) Prior Publication Data

US 2008/0257931 A1 Oct. 23, 2008

(30) Foreign Application Priority Data

Apr. 20, 2007 (TW) ..... 96114072 A

(51) Int. Cl.
*B27F 7/17* (2006.01)
*B26F 1/32* (2006.01)

(52) U.S. Cl. ..... 227/64; 227/176.1; 227/19; 227/120; 7/160

(58) Field of Classification Search ..... 227/64, 227/176.1, 19, 120; 7/160
See application file for complete search history.

(56) References Cited

U.S. PATENT DOCUMENTS

| | | | | |
|---|---|---|---|---|
| 3,889,865 | A * | 6/1975 | Kuypers | 227/109 |
| 4,801,061 | A * | 1/1989 | Mangone, Jr. | 227/120 |
| 5,639,007 | A | 6/1997 | Nakamura | |
| 7,311,236 | B2 * | 12/2007 | Smith et al. | 227/131 |
| 2006/0049228 | A1 * | 3/2006 | Shen | 227/120 |
| 2008/0296340 | A1 * | 12/2008 | Wang | 227/109 |

FOREIGN PATENT DOCUMENTS

| | | |
|---|---|---|
| CN | 2244479 | 1/1997 |
| CN | 2336965 | 9/1999 |
| CN | 2411893 | 12/2000 |
| TW | 379634 | 1/2000 |
| TW | 490367 | 6/2002 |

* cited by examiner

*Primary Examiner*—Brian D Nash
(74) *Attorney, Agent, or Firm*—Kirton & McConkie; Evan R. Witt

(57) ABSTRACT

Disclosed is a stapler having various operation modes, as well as methods for switching the stapler among the operation modes. The stapler includes a primary staple magazine, a secondary staple magazine, a staple selector, a drive blade selector and a cover. The primary and secondary magazines respectively contain primary and secondary staples. The staple selector and the drive blade selector are movable for switching the stapler between primary and secondary staple modes. The stapler also includes a perforation for performing a perforating operation, and a switch for securing the stapler in a collapsed, compact form to simplify storage thereof. The stapler is switchable among a primary staple mode, a secondary staple mode, a perforation mode and a storage mode by means of the staple selector and the drive blade selector.

8 Claims, 13 Drawing Sheets

STAPLER SWITCHABLE BETWEEN VARIOUS OPERATION MODES AND SWITCHING METHOD THEREOF

FIELD OF THE INVENTION

The present invention generally relates to a multi-function stapler switchable between various operation modes and a switching method thereof, and more particularly to a stapler capable of switching between a primary staple mode, a secondary staple mode, a perforation mode and a storage mode, and the switching methods of the same.

BACKGROUND OF THE INVENTION

Nowadays, although many documents are prepared using personal computers or handwriting, printing or photocopying is often needed to present the final form of documents. In printing or photocopying documents, the documents are made in individual and separate sheets, which have to be bound together as a consistent copy of documents. Nowadays, stapling is one of the most commonly and readily available binding techniques for loose pages of documents.

The implementation of a conventional stapler is to utilize staples that are each formed by two spaced pins or legs and are received and stored in the stapler. With a striking operation carried out by the stapler, the staples are sequentially and successively struck out of the stapler to force the pins thereof into the documents to complete the binding of the documents. The tips of the pins that extend through the documents are bent to fix the sheets of the documents together. Since the stapler has the advantages of being cheap and being convenient to use, many offices, schools, hospitals, homes and other places often regard the staplers as an essential accessory.

The staples which are placed in a stapler have different specifications. The most commonly used in a small size staple, which is referred to as No. 10 staple and has a binding capability of around 15 pages of documents. For documents having pages more than 15, a larger size stapler and the associated staples must be used, such as No. 3 staples, which is capable to bind some 30 pages.

For this reason, staplers that are capable of operation with two sizes of staples are available in the market. However, this kind of stapler only has single staple magazine to receive either small size staples or large size staples in an alternate manner. In other words, the stapler must be opened to remove the original staples before another size of staples can be used. Apparently, such a known stapler has drawbacks, such as inefficiency and inconvenience for exchanging the other size of staples or reloading of the staples. In other words, it results in lack of applicability for blinding. Furthermore, the conventional stapler might result in hurting the operator if the operator's fingers grab at a pin plate, which disposed on a base of the stapler, in exchanging the staples or reloading the staples. In addition, after exchanging the other size of staples or reloading the staples, it is necessary to apply a downward force to the cover to close it up and making the staples in a position. As a result, it is always wasting the first staple because when a downward force is applied to the cover, the first staple is inadvertently struck out of the stapler without binding any document.

In addition, because a force ratio of output to input of the conventional stapler is 1:1, the known stapler needs more force on binding more pages of documents. It is usually wasting the staples because the large force may easily make the staple slanted and not penetrating into the documents to be bound. Furthermore, the known stapler that can accommodate staples of different sizes is bulky in size and is also very heavy and cannot be closed to a compact form. All these make it difficult to carry and store easily.

Consequently, there is a need to develop a stapler operable with staples of different sizes and switchable among different operation modes without opening the stapler. And reloading the stapler can be easily done by removing a staple magazine therefrom. Furthermore, the stapler can also function as a punch that carries out perforating operation on documents. The stapler can also be closed to a compact form to ease storage thereof. Therefore, the stapler has the advantages of saving staples, increasing variety of use and enhancing convenience and the safety of operation and reloading staples. In addition, the stapler also has the advantage of being convenient to carry.

SUMMARY OF THE INVENTION

To overcome the foregoing drawbacks in the prior art, it is an objective of the present invention to provide a stapler switchable among a primary staple mode for striking staples of a first size, a secondary staple mode for striking staples of a second size, a perforation mode for punching documents, and a storage mode for converting into a compact form for easy storage. All these modes can be initiated without opening the stapler and re-loading staples of different sizes.

Another objective of the present invention is to provide a method for switching a stapler between a primary staple mode and a secondary staple mode so that the stapler exchangeably uses two sizes of staples without opening the stapler.

A further objective of the present invention is to provide a method for switching a stapler between a perforation mode and a storage mode so that the stapler can selectively perform perforating operations and can also be closed down to a compact form for easing storage thereof.

In accordance with an aspect of the present invention, a stapler is provided, comprising a primary staple magazine and a secondary staple magazine for respectively receiving and containing primary staples and secondary staples, a staple selector for switching between the primary and secondary staples, a drive blade selector for driving a drive blade to apply a striking force to a selected one of the staples, and a staple magazine retainer for selectively fixing and/or releasing the primary staple magazine and the secondary staple magazine out of the stapler to reload the staple magazines. The stapler also comprises a perforation bar and a switch. The perforation shaft is used for performing a perforating operation, and the switch is used for assisting collapsing the stapler into a compact form for easing storage thereof.

Furthermore, in accordance with another aspect of the present invention, a method for switching a stapler among a primary staple mode, a secondary staple mode, a perforation mode, and a storage mode is provided, which method is carried out by means of a staple selector and a drive blade selector, which allow for selection of staples and drive blades. In addition, the staple allows for easy reloading of staples by simply removing the primary staple magazine and/or the secondary staple magazine out of the stapler.

As the mentioned above, the present invention provides a stapler which is switchable between two different sizes of staples without opening the cover and reloading of staples can be easily done by removing a staple magazine out of the stapler. Furthermore, the stapler can also serve as a paper punch for performing a perforating operation, and also, the stapler can be closed or collapsed to a compact form for easing storage thereof. Therefore, the stapler has the advantages of saving staples, increasing variety of use, and enhancing convenience and safety in reloading staples. In addition, the stapler also has the advantage of being convenient to carry.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
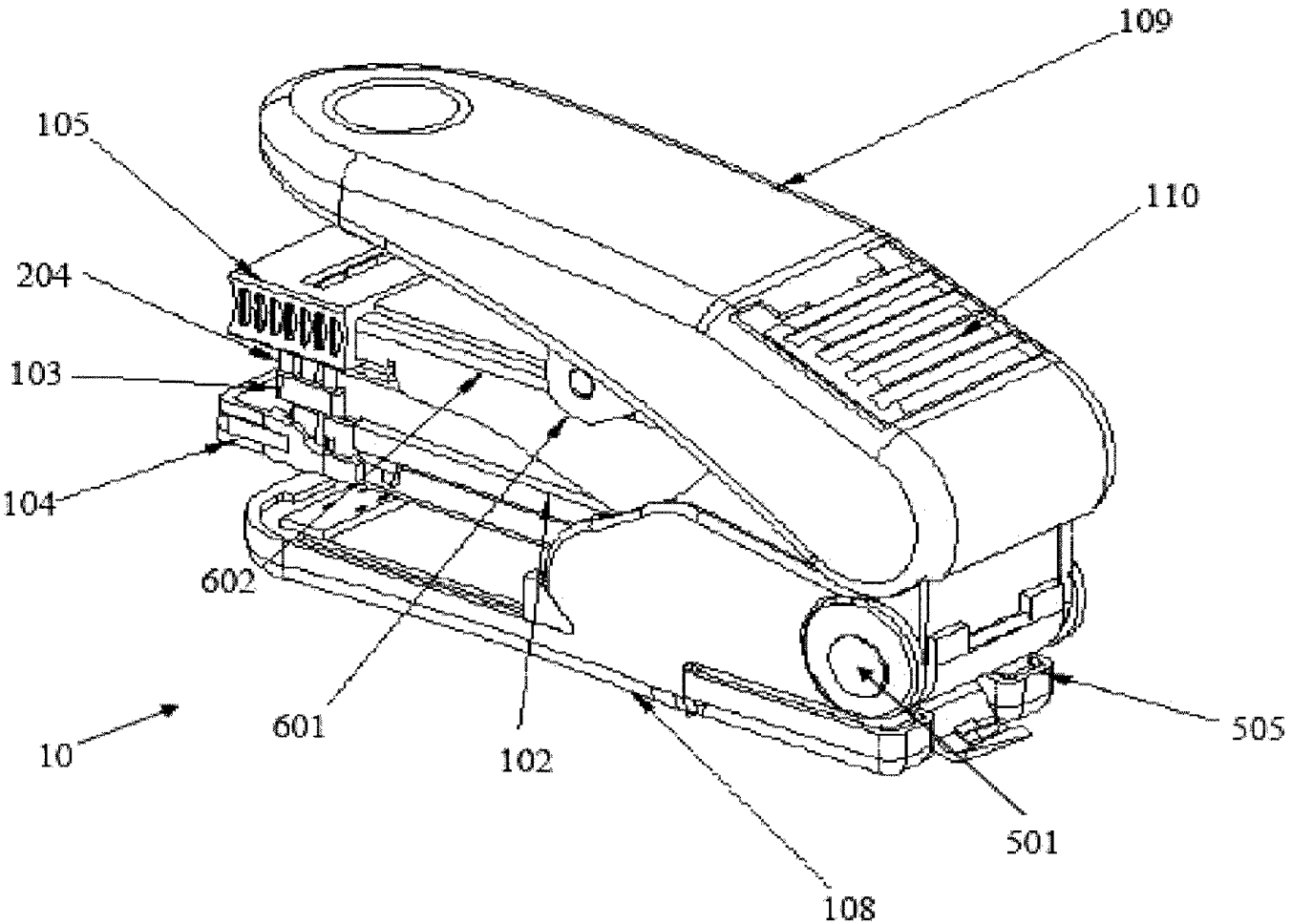
FIG. 1 is a perspective view of a stapler constructed in accordance with the present invention.
Figure 2:
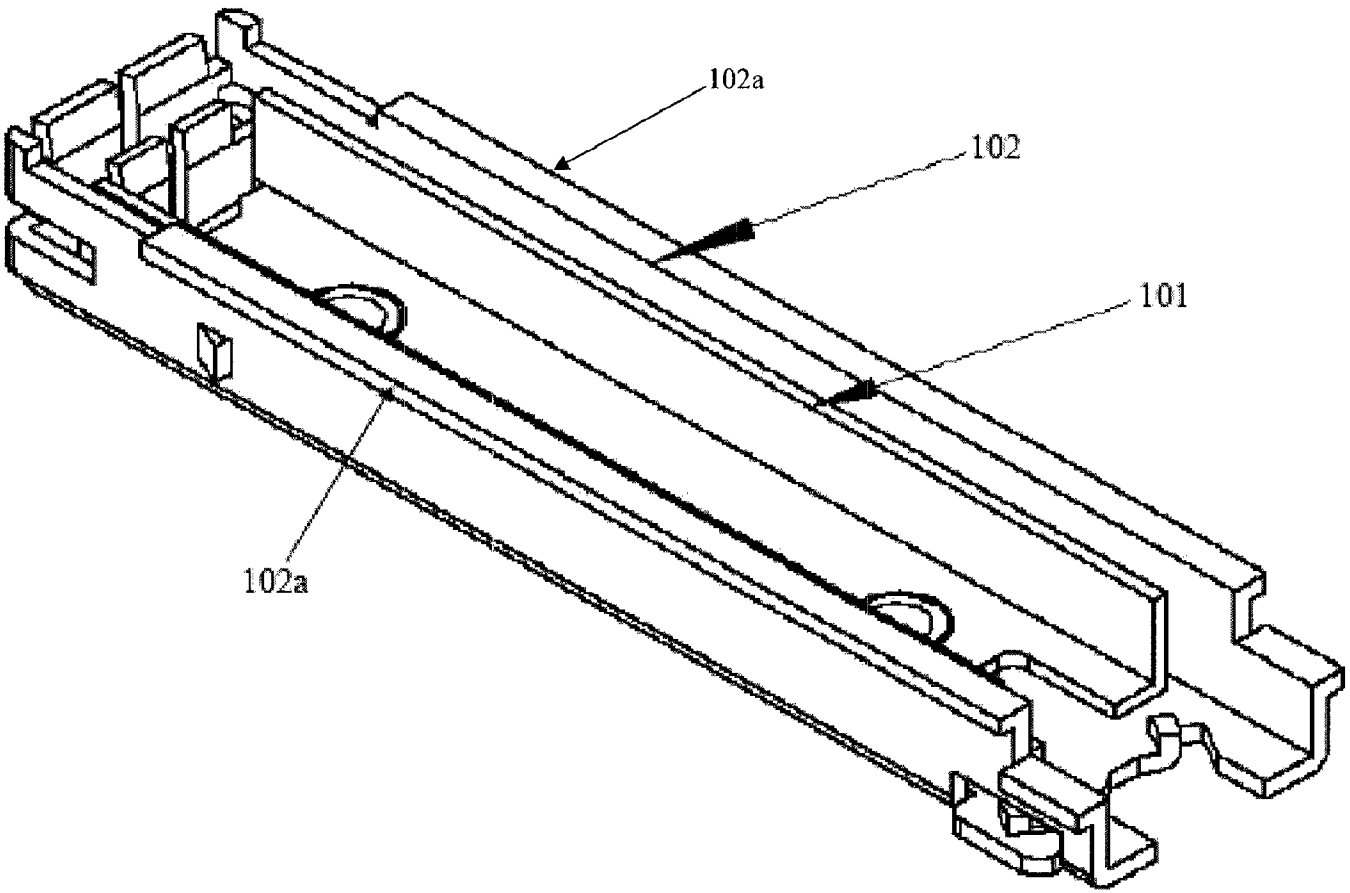
FIG. 2 is a perspective view of a staple carrier structure comprised of a primary staple magazine and a secondary staple magazine of the stapler of the present invention.

With reference to the drawings and in particular to FIGS. 1 and 2, a stapler constructed in accordance with present invention, generally designated at 10, comprises a primary staple magazine 101, a secondary staple magazine 102, a magazine rack 103, a staple selector 104, a drive blade selector 105, a base 108, a cover 109, a switch 110, a drive blade fillister 204, a staple magazine retainer 501, a removable cover 505, an effort-saving press lever 601 and a press shaft 602. These components/parts will be sequentially illustrated in detail in the following description. Also given in the following is the operation of the stapler in accordance with the present invention.

As best shown in FIG. 2, the stapler comprises a staple carrier structure that is composed of the primary staple magazine 101 and the secondary staple magazine 102. The primary staple magazine 101 is of a smaller size and is arranged inside and securely fixed to the secondary staple magazine 102, which is of a larger size, in such a way that a left side wall, a right side wall and a front wall of the primary staple magazine 101 are spaced from the counterpart left side wall, right side wall, and front wall of the secondary staple magazine 102 by distances. In other words, the primary staple magazine 101 is received in the secondary staple magazine 102 with only a bottom of the primary staple magazine 101 fixed to a bottom of the secondary staple magazine 102. In addition, two bars 102*a* are formed along the left and right side walls of the secondary staple magazine 102 in the form of sideway projecting flanges.

The primary staple magazine 101 functions to receive and contain therein staples of a first, small size (or specification), which will be referred to as "primary staples" 60 (see FIGS. 7-13) hereinafter. The secondary staple magazine 102 receives and contains therein staples of a second, large size (or specification), which will be referred to as "secondary staples" 61 (also see FIGS. 7-13) hereinafter. Therefore, when the secondary staples 61 are deposited in the secondary staple magazine 102, each secondary staple 61 has a top portion or crown spanning between the left and right side walls of the primary staple magazine 101 and opposite pins (or legs) extending from the top portion and movably received in the gaps or distances respectively defined between the left side walls and right side walls of the primary staple magazine 101 and the secondary staple magazine 102 so that the secondary staples 61 cover the primary staple magazine 101 and also covers the primary staples 60, if any, received in the primary staple magazine 101.

Figure 3:
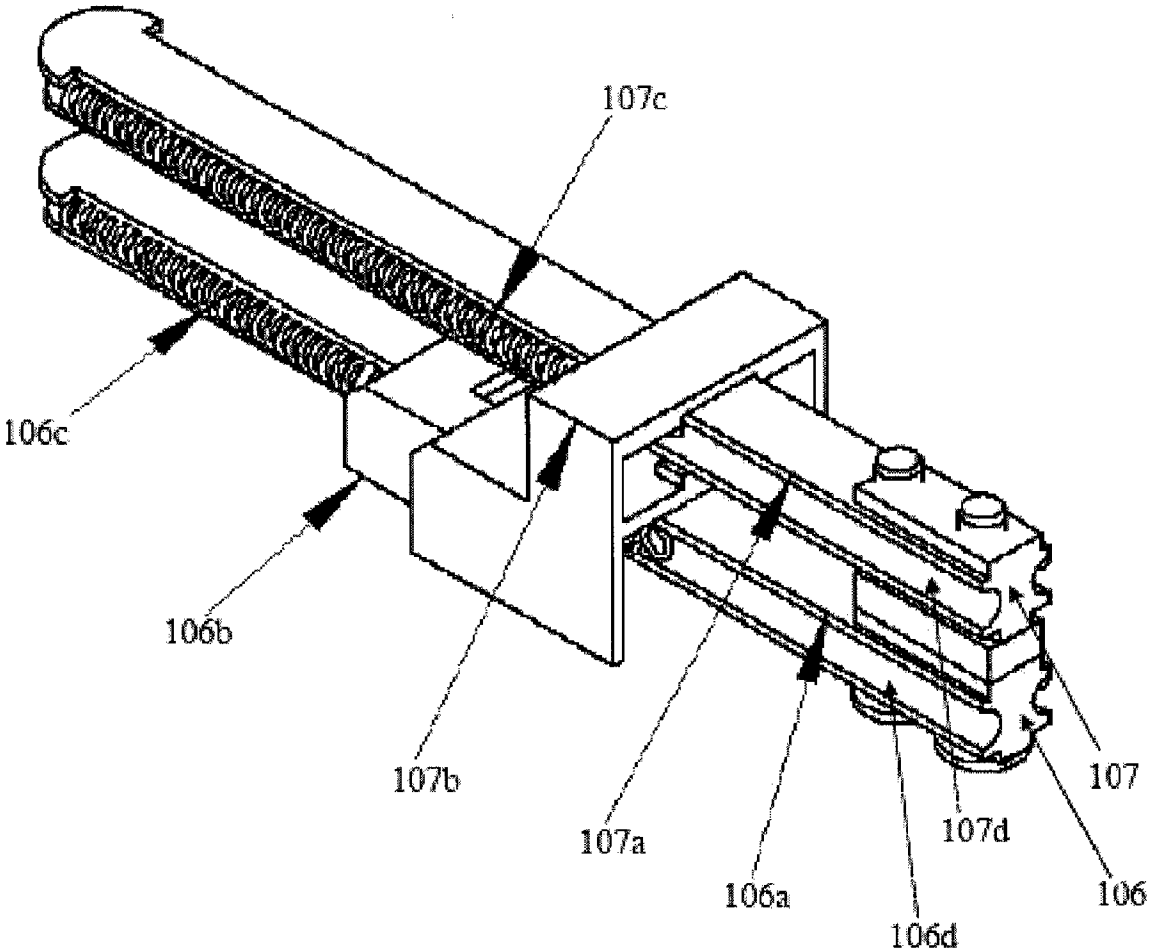
FIG. 3 is a perspective view of a primary staple pusher and a secondary staple pusher of the stapler of the present invention.

Also referring to FIG. 3, which shows a primary staple pusher 106 and a secondary staple pusher 107 of the stapler 10 in accordance with the present invention, the primary staple pusher 106 and the secondary staple pusher 107 respectively comprise a primary slide rail 106*a* and a secondary slide rail 107*a*, each being configured as a horizontally-extending elongate flat bar. It is noted the term "horizontally" or other direction-related terminologies as used herein are used to facilitate understanding of the present invention and indicating the direction that is shown in the drawings, and not constituting any limitation to the orientation of use of the stapler. The primary slide rail 106*a* is arranged below the secondary slide rail 107*a*. In addition, a primary pushing slide 106*b* is movable along the primary slide rail 106*a* to server as a movable pushing block. Preferably, the primary pushing slide 106*b* is made hollow and movably fit over the primary slide rail 106*a*. A secondary pushing slide 107*b* is formed as a hollow member having a first hollow portion fit over and movable along the secondary slide rail 107*a* to serve as a movable pushing block. The secondary pushing slide 107*b* is preferably of an L-shaped side elevational configuration having a reduced upper portion in which the first hollow portion is formed and an expanded lower portion forming a second hollow portion which allows extension of the primary pushing slide 106*b* therethrough during the movement of the primary pushing slide 106*b*. In other words, when the primary pushing slide 106*b* and the secondary pushing slide 107*b* are individually moving along the primary slide rail 106*a* and the secondary slide rail 107*a*, the primary pushing slide 106*b* is allowed to pass through the second hollow portion of the secondary pushing slide 107*b* without restriction of movement thereof.

As shown in FIG. 3, the primary slide rail 106*a* and the secondary slide rail 107*a* each form in a side face thereof a sideways open channel 106*d* and a sideways open channel 107*d*, which respectively receive therein a spring 106*c* and a spring 107*c* for the primary slide 106*b* and the secondary slide 107*b*. Preferably, the channels 106*d*, 107*d* are of a lying U-shape. It is, however, noted that similar channels can be formed on the other sides or opposite side faces, which are not visible in FIG. 3, of the primary slide rail 106*a* and the secondary slide rail 107*a* to similarly accommodate springs. The spring 106*c*, which is received in the channel 106*d*, has opposite ends respectively fixed to an end of the primary slide rail 106*a* and the primary pushing slide 106*b* to apply a biasing force therebetween. Similarly, the spring 107*c*, which is received in the channel 107*d*, has opposite ends respectively fixed to an end of the secondary slide rail 107*a* and the secondary pushing slide 107*b* to apply a biasing force therebetween.

Figure 4:
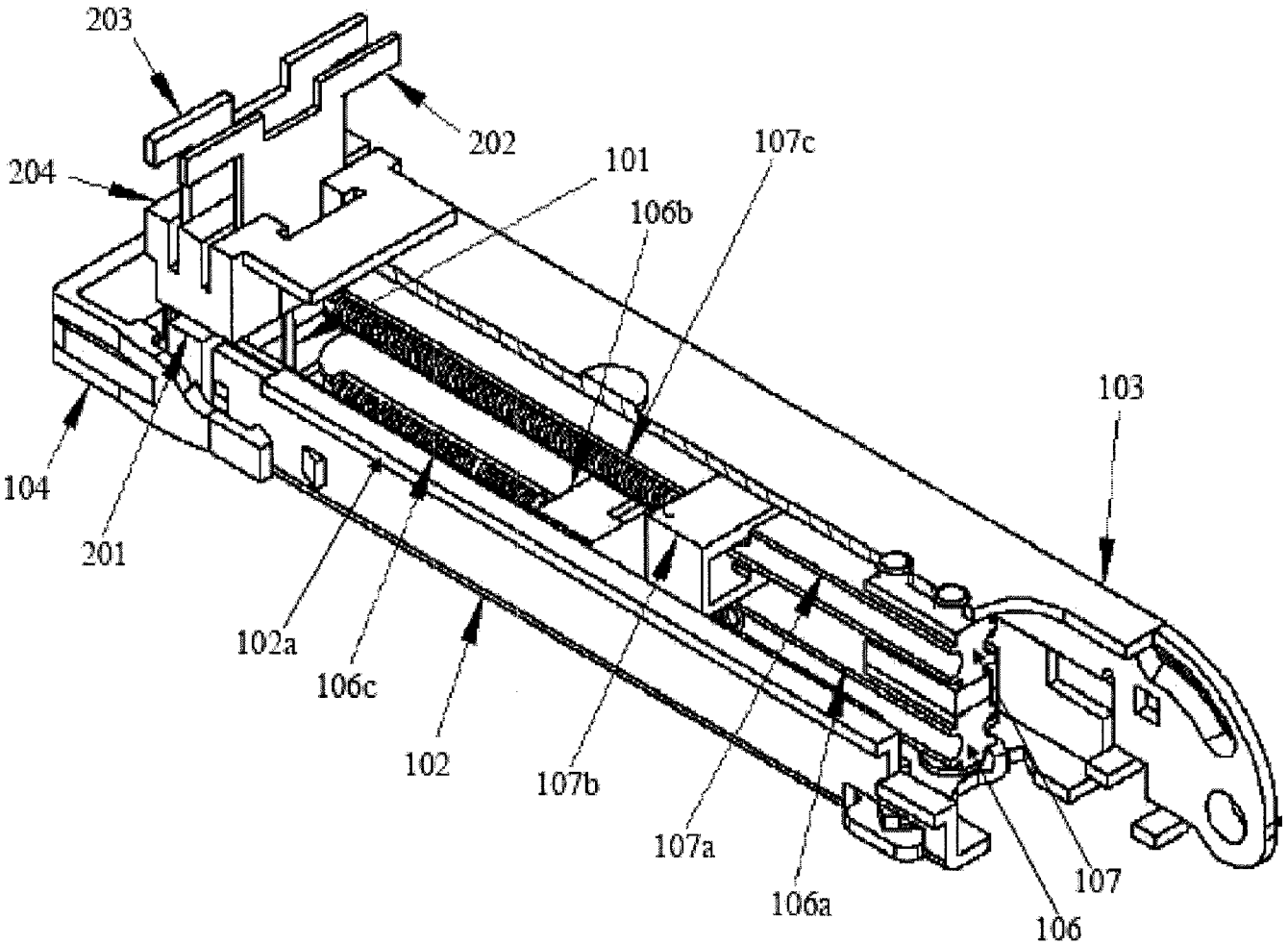
FIG. 4 is a perspective view, partially broken, illustrating an internal assembly of parts of the stapler of the present invention.
Figure 13:
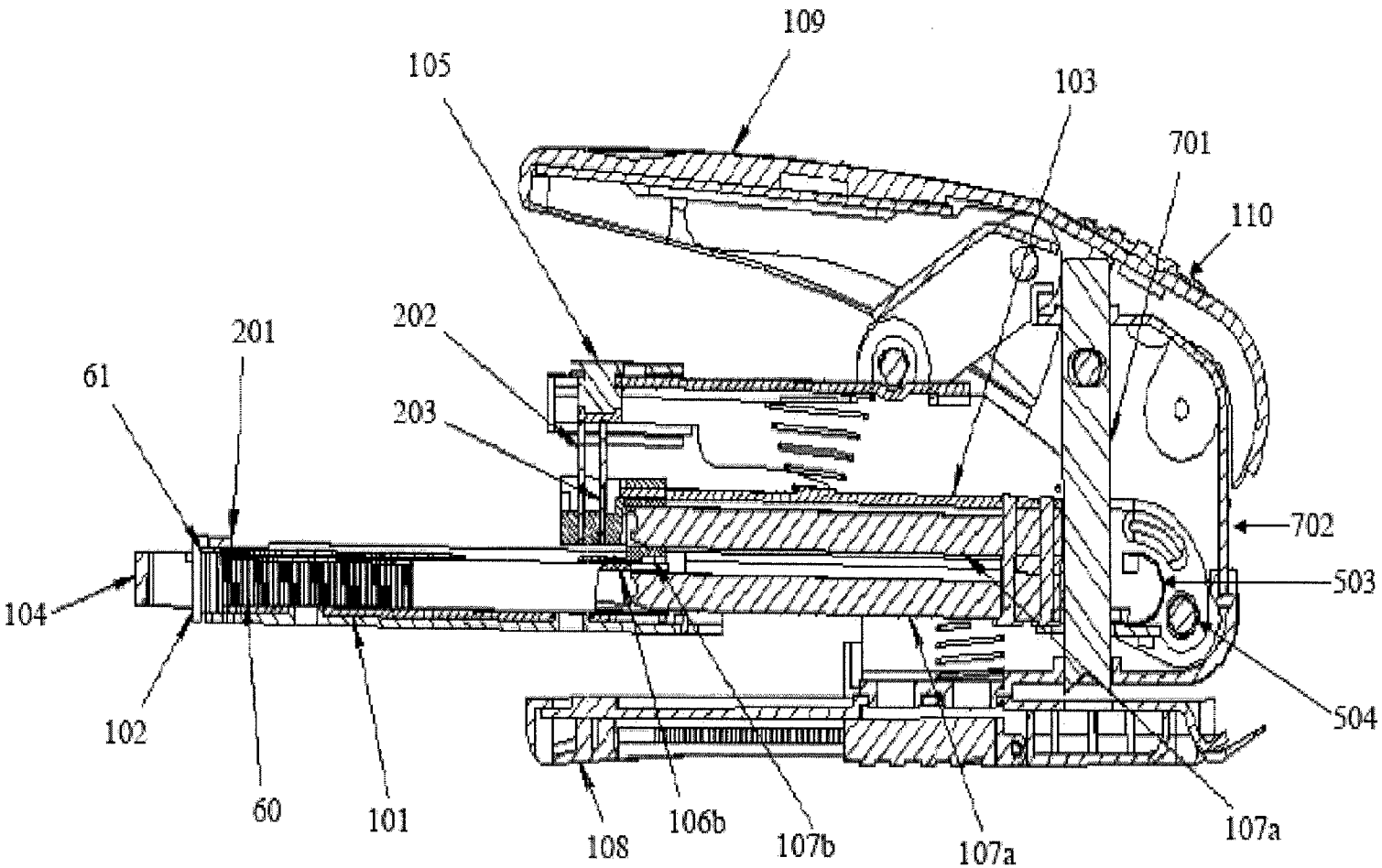
FIG. 13 is a side elevational view, in sectioned form, illustrating reloading staples for the stapler of the present invention.

Referring to FIG. 4, the primary staple magazine 101 and the secondary staple magazine 102 are both disposed inside the magazine rack 103. The bars 102*a*, which are formed opposite side walls of the secondary staple magazine 102, are set in sliding and fitting engagement with opposite inside surfaces of the magazine rack 103 to form slidable coupling therebetween so that the stapler carrier structure, which comprises the primary and secondary staple magazines 101, 102, is movable with respect to the magazine rack 103, as best seen in FIG. 13, for replacing or re-filling of the magazines 101, 102. In addition, a blockader 201 is arranged at a front end of the secondary staple magazine 102 and has all inverted U-shaped structure straddling over the opposite side walls of the secondary staple magazine 102 with two legs of the inverted U-shape positioned against the opposite side walls of the front end portion of the secondary staple magazine 102 to set the blockader 201 at the front end portion of the secondary staple magazine 102. Thus, the blockader 201 is substantially vertical and normal to the secondary staple magazine 102. The blockader 201 is movable horizontally in a front-rear direction with respect to the secondary staple magazine 102 for selectively blocking and thus restricting striking movement of a primary drive blade 202.

The staple selector 104 has a shape of a lying U having legs extending substantially horizontally and straddling over opposite side walls of the front end portion of the secondary staple magazine 102. The staple selector 104 is horizontally movable with respect to the secondary staple magazine 102 between a first, engaged position and a second, release position to select between the primary staples 60 and the secondary staples 61. Preferably, the staple selector 104 has portions engageable with the secondary staples 61 that have been deposited in the secondary staple magazine 102 so that when the staple selector 104 moved first engaged position, the secondary staples 61 are forced off a struck position and striking of the secondary staples 61 is impossible. This will be further discussed.

The drive blade fillister 204 is arranged above blockader 201 and is fixed. The drive blade fillister 204 carries the primary drive blade 202 and a secondary drive blade 203 that are located above the blockader 201. The primary and secondary drive blades 202, 203 are movable with respect to the drive blade fillister 204 for being selectively operated to apply a downward force to the primary and secondary staples 60, 61 respectively to strike the staples 60, 61 out of the primary and secondary staple magazines 101, 102.

In addition, as shown in FIG. 4, the primary staple pusher 106 and the secondary staple pusher 107 are disposed inside the primary staple magazine 101 to individually push the primary staples 60 and the secondary staples 61 forward to the front ends of the primary staple magazine 101 and the secondary staple magazine 102 by means of the biasing forces of the springs 106*c*, 107*c* acting on the primary and secondary slides 106*b*, 107*b*.

Figure 5:
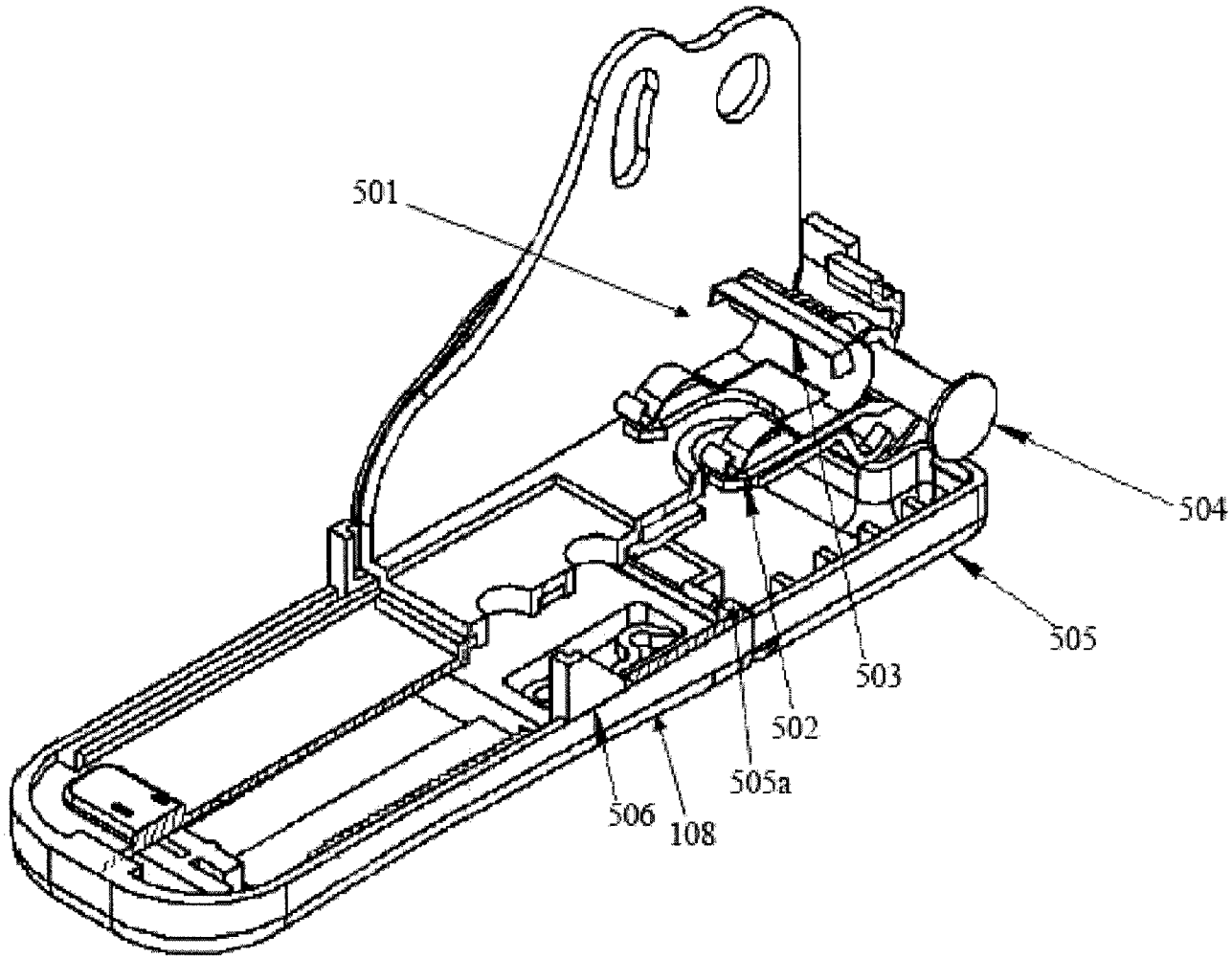
FIG. 5 is a perspective view, partially broken, of a base of the stapler of the present invention.

Referring to FIG. 5, which illustrates the structure of the base 108 of the stapler 10 according to the present invention, the base 108 has a bottom to which the removable cover 505 is releasably mounted. Preferably, the removable cover 505 is pivotally connected to the base 108 by a pivot 505*a* so that the movable cover 505 is movable between a closed position where the cover 505 is closed up to the bottom of the base 108 to serve as a collector for storing punched paper scraps and an open position where the cover 505 is rotated away from the bottom of the base 108 to release the collected paper scraps. In addition, the base 108 is provided with a positioner 506 that functions to maintain a selected, constant margin of binding. In other words, the stapler 10 can achieve consistency of binding by adjusting the positioner 506 according the distance which is demanded.

The staple magazine retainer 501 is disposed above the movable cover 505 as shown in FIG. 5. The staple magazine retainer 501 comprises one or more crooks 502 and a resilient plate 503. The crooks 502 are used for hooking the staple carrier structure that is comprised of the primary staple magazine 101 and the secondary staple magazine 102 to thereby retainer the primary and secondary staple magazines 101, 102 in positions inside the stapler 10. The resilient plate 503, serving as a spring that applies a biasing force to the staple carrier structure, is disposed above the metal crook 502 and is used to push the primary staple magazine 101 and the secondary staple magazine 102 out of the stapler 10 by the biasing force. Moreover, a release button 504 is disposed behind the resilient plate 503 for releasing the staple carrier structure from the crooks 502 to allow the primary and secondary staple magazines 101, 102 to be moved out of the stapler 10.

Figure 6:
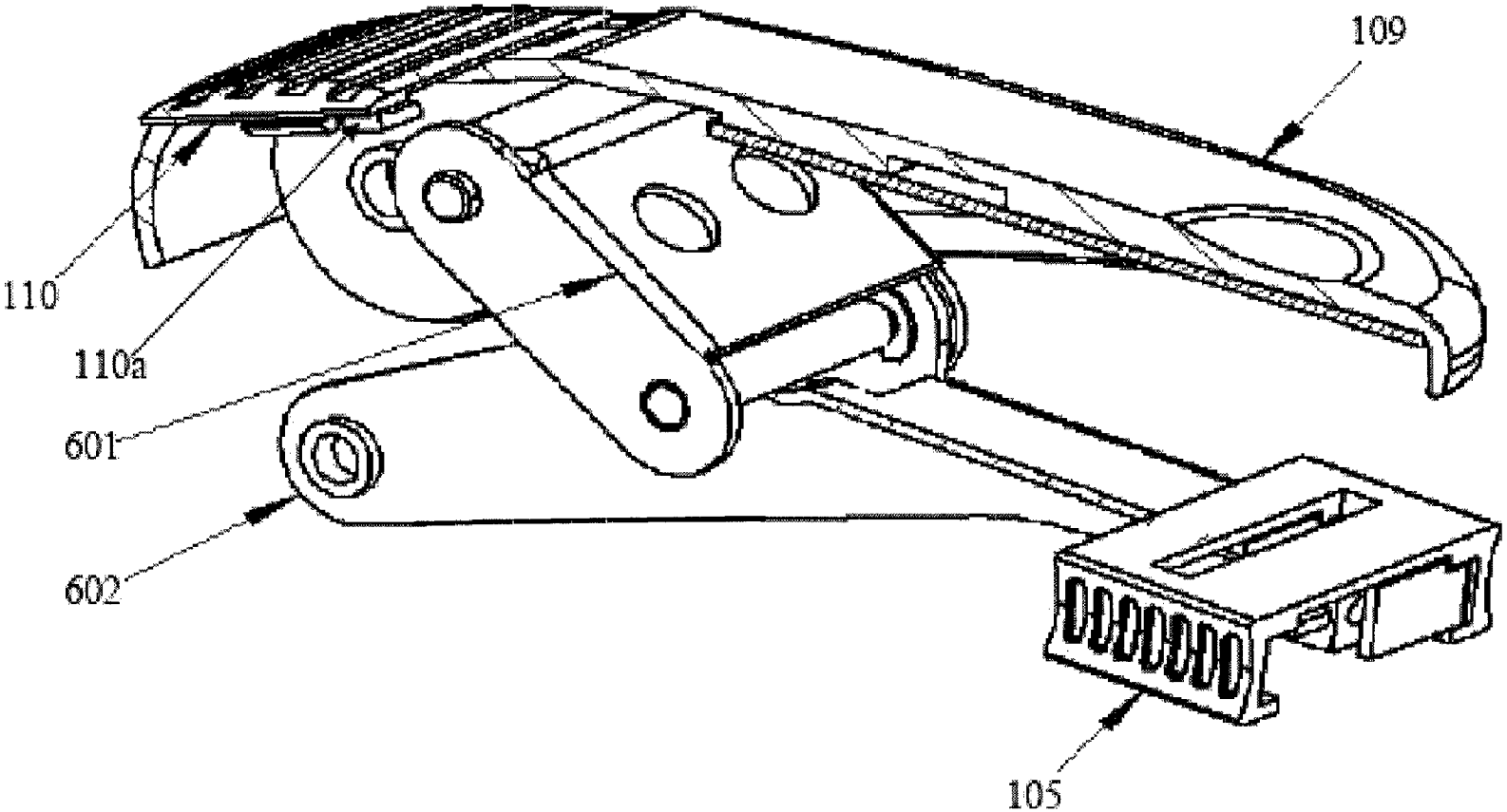
FIG. 6 is a perspective view, partially broken, of a cover of the stapler of the present invention.

Referring to FIG. 6, which illustrates the cover 109 of the stapler 10 according to the present invention, the switch 110 is movably formed on the cover 109. When the switch 110 is moved to an activated position by moving toward a front end of the cover 109, the cover 109 is forcibly closed down to the drive blade selector 105 so that the stapler 10 can be closed to assume a compact configuration for easy storage. The drive blade selector 105 is a movable member that is movably coupled to the primary drive blade 202 and the secondary drive blade 203, which are showed in FIG. 4, in such a way that the drive blade selector 105 has opposite slots in which opposite projections of each drive blades 202, 203 are slidably received to allow the drive blade selector 105 to slide with respect to the drive blades 202, 203 for selectively not driving the primary drive blade 202. This is done by aligning an opening (not labeled) defined in the drive blade selector 105 with the primary drive blade 202 so that depressing the drive blade selector 105 downward does not apply any driving force to the primary drive blade 202 for the primary drive blade 202 is allowed to extend into the opening.

In addition, the effort-saving press lever 601 is disposed between the cover 109 and the press shaft 602 so that the effort-saving press lever 601 can participate with the force for pressing the cover 109.

Figure 7:
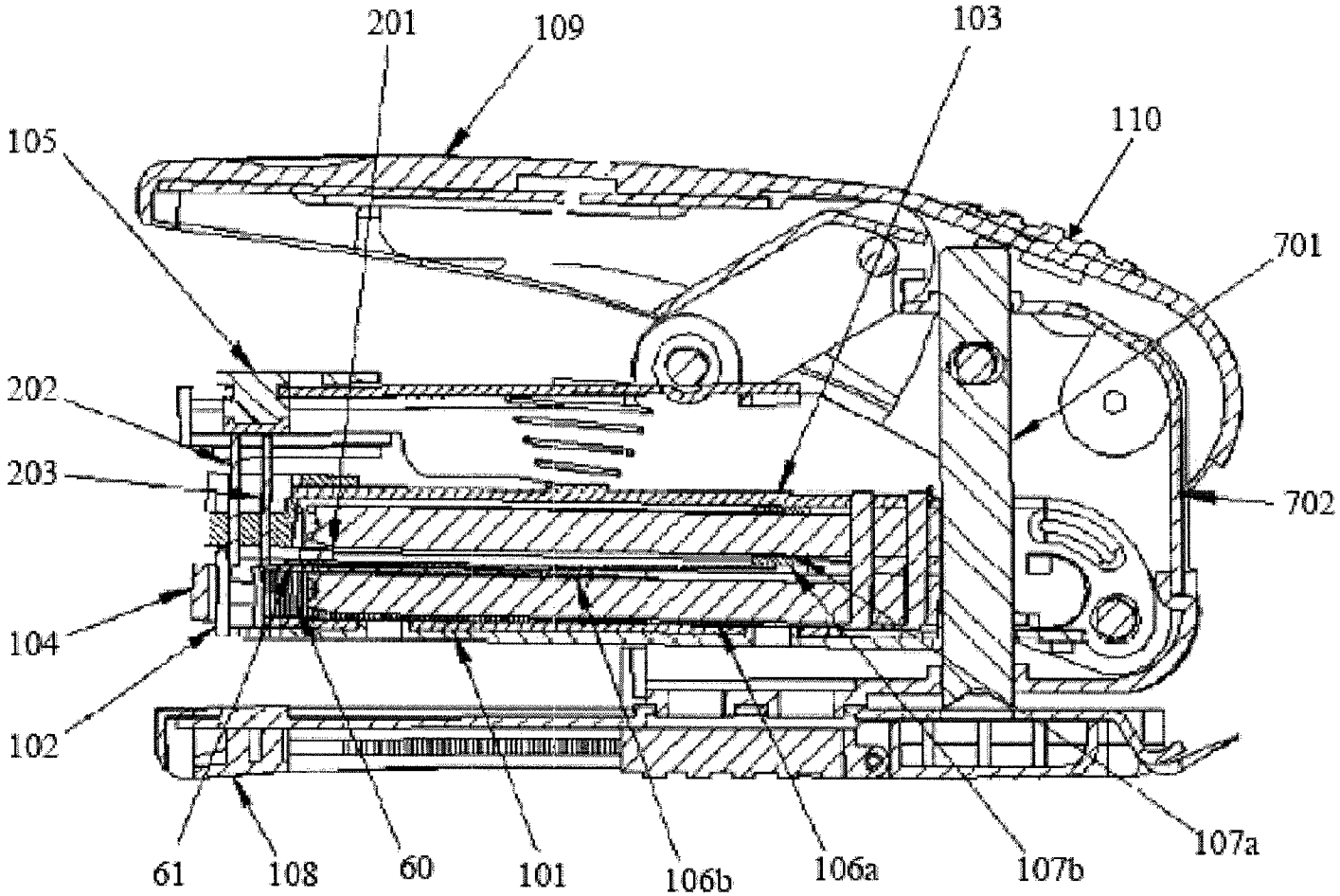
FIG. 7 is a side elevational view, in sectioned form, illustrating a primary staple mode of the stapler of the present invention.

Referring to FIG. 7, a primary staple mode of the stapler 10 according to the present invention will be described. The primary staple mode is used for binding document sheets of regular thickness. For example, about fifteen sheets of documents can be bound with the primary staples 60 in the primary staple mode. The staple selector 104 and the drive blade selector 105 are individually set in an initial status, wherein the staple selector 104 is pushed rearward of the stapler 10 to set at the first engaged position where the secondary staples 61, if any, is acted upon by the staple selector 104 and is thus forced rearward to locate behind the primary drive blade 202 and the secondary drive blade 203. Also, the blockader 201, which is preferably fixed to the staple selector 104, is set to locate behind the primary and secondary drive blades 202, 203 whereby the blockader 201 does not interfere with downward movement of the primary and secondary drive blades 202, 203. Under this condition, with the biasing force of the spring 106*c* of the primary pushing slide 106*b* acting against the primary staples 60, the first one of the primary staples 60 is set exactly below the primary drive blade 202. Further, as shown in FIG. 7, the drive blade selector 105 is moved rearward to a position where driving coupling is established between the drive blade selector 105 and both the primary and secondary drive blades 202, 203. At this time, applying a downward force to the cover 109 causes both the primary drive blade 202 and the secondary drive blade 203 to be simultaneously depressed downward by the drive blade selector 105. Since the secondary staples 61 are moved rearward and off the struck position thereof, the downward movement of the secondary drive blade 203 does not hit any of the secondary staples 61 and the secondary drive blade 203 is allowed to get into the space between the front walls of the primary and secondary staple magazines 101, 102, striking no secondary staple 61. On the other hand, the primary drive blade 202 hits and strikes the first one of the primary staples 60 that is located therebetween to realize stapling of the primary staples in accordance with the primary staple mode.

Furthermore, in the primary staple mode, the primary staples 60, when loaded into the primary staple magazine 101, forces the primary pushing slide 106*b* rearward and at the same time deforming the spring 106*c* to build up potential energy therein. Once the first one of the primary staples 60 is struck out of the stapler 10, the spring 106*c* releases a portion of the potential energy thereof to move the primary pushing slide 106*b* forward and thus urging the primary staples 60 forward to have the next staple 60 located exactly below the primary drive blade 202. With the release of the potential energy, the spring 106*c* gradually reinstates the initial, undeformed status.

Figure 8:
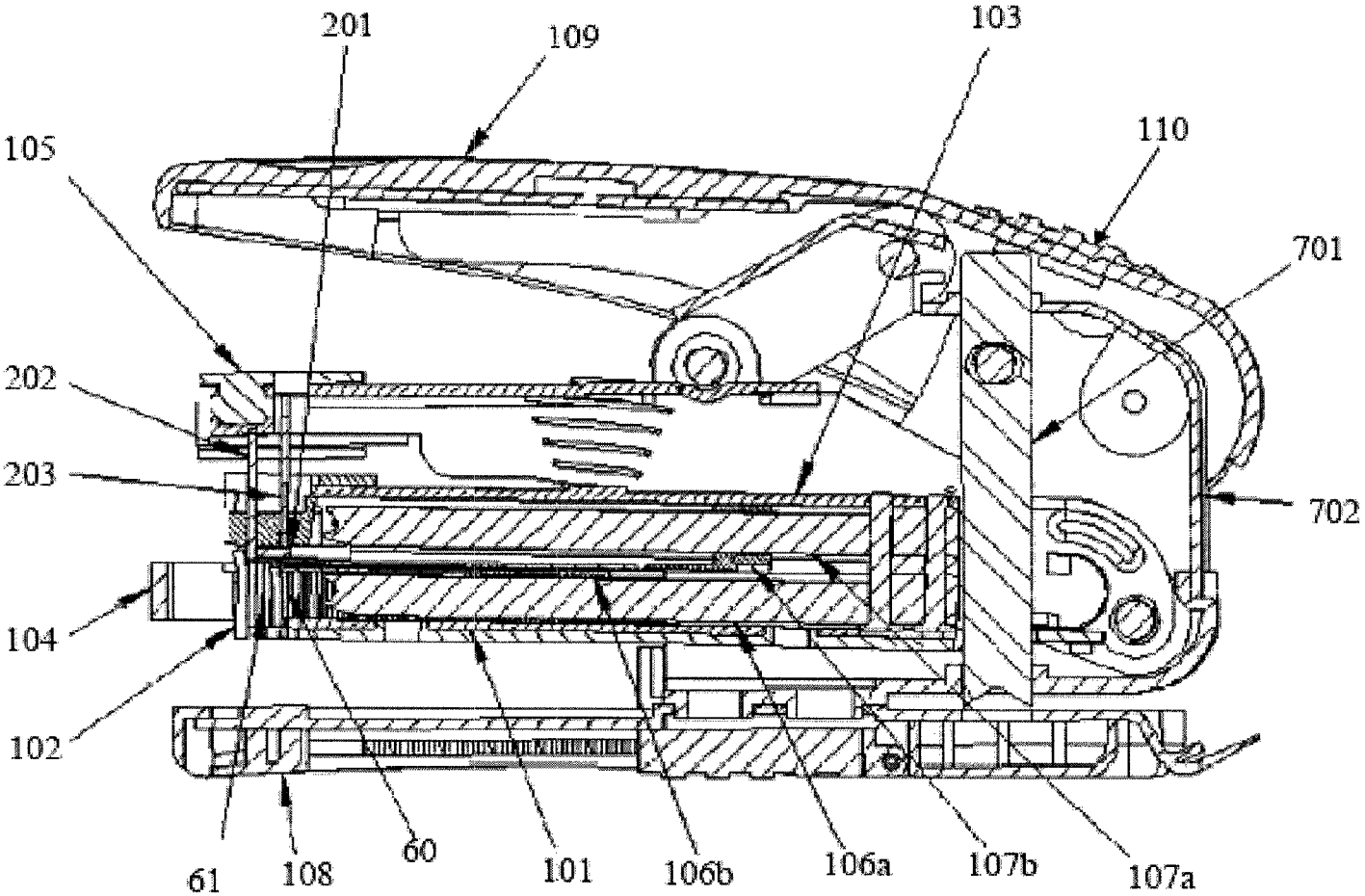
FIG. 8 is a side elevational view, in sectioned form, illustrating a secondary staple mode of the stapler of the present invention.

Referring to FIG. 8, a secondary staple mode of the stapler 10 according to the present invention will be described. The secondary staples mode is used for binding sheets of document of a great thickness. For example, about thirty sheets of documents can be bound with the secondary staples 61 in the secondary staple mode. The staple selector 104 is pulled outward and set at a second released position, where the secondary staples 61 are no longer acted upon by the staple selector 104 and the spring 107*c* releases the potential energy thereof to drive the secondary pushing slide 107*b* forward and thus urging the secondary staples 61 forward to have a first one of the secondary staples 61 located in front of the primary staples 60 and exactly below the secondary drive blade 203. The blockader 201 is moved to a position where the primary drive blade 202 is blocked, but the secondary drive blade 203 is not and is thus allowed to move downward. The drive blade selector 105 is moved to a position to have only the secondary drive blade 203 coupled thereto, while the primary drive blade 202 is substantially aligned with the opening of the drive blade selector 105. At this time, applying a downward force on the cover 109 causes the secondary drive blade 203 to be depressed downward by the drive blade selector 105; however, the blockader 201 blocks the downward movement of the primary drive blade 202 so that the primary drive blade 202 moves with respect to the drive blade selector 105 and extends through the opening defined in the drive blade selector 105 without striking any primary staple. In other words, the secondary drive blade 203 strikes the first one of the secondary staples 61 out of the stapler 10 to realize stapling of the secondary staples in accordance with the secondary staple mode.

Furthermore, in the secondary staple mode, the secondary staples 61, when loaded into the secondary staple magazine 102, forces the secondary pushing slide 107*b* rearward and at the same time deforming the spring 107*c* to build up potential energy therein. Once the first one of the secondary staples 61 is struck out of the stapler 10, the spring 107*c* releases a portion of the potential energy thereof to move the secondary pushing slide 107*b* forward and urging the secondary staples 61 forward to have the next staple 61 located exactly below the secondary drive blade 203. With the release of the potential energy, the spring 107*c* gradually reinstates the initial, un-deformed status.

Figure 9:
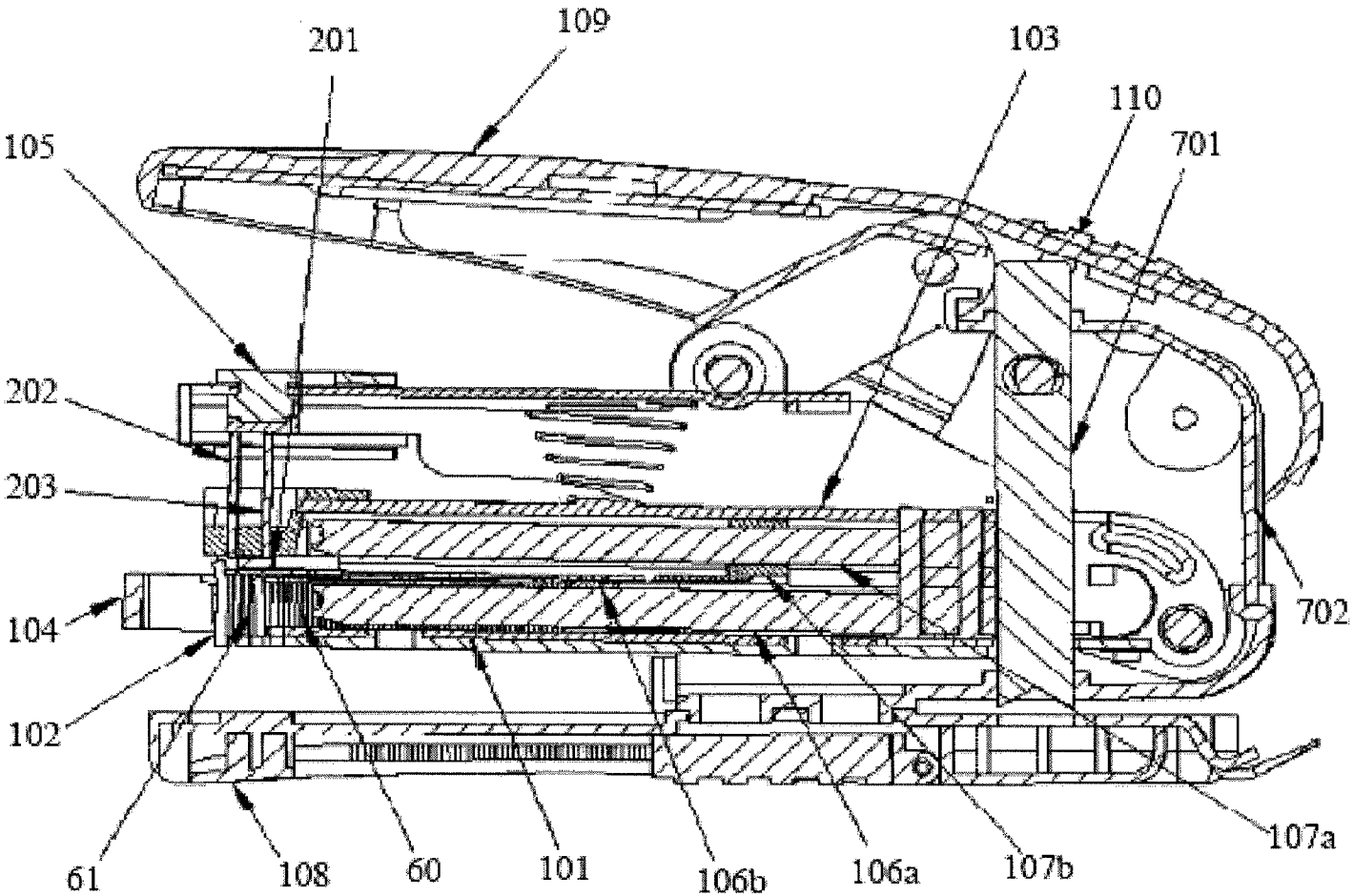
FIG. 9 is a side elevational view, in sectioned form, illustrating a safe mode of the stapler of the present invention.

Referring to FIG. 9, a safe mode of the stapler 10 according to the present invention will be described. The safe mode ensures that switching between the primary staple mode and the secondary staple mode can be correctly carried out without resulting in any breakdown of the stapler 10. For example, the staple selector 104 is set in the engaged position, while the drive blade selector 105 is set in the corresponding position. As shown in FIG. 9, when the staple selector 104 is pulled forward to the released position, the spring 107*c* forces the secondary pushing slide 107*b* to urge the secondary staples 61 forward to be located in front of the primary staples 60. The blockader 201 is set in a position where it is located above the front-most one of the primary staples 60 and is thus below the primary drive blade 202. At this moment, the secondary drive blade 203 is located above the first one of the secondary staples 61. The drive blade selector 105 is coupled to both the primary drive blade 202 and the secondary drive blade 203. Under this situation, applying downward force to the cover 109 causes the drive blade selector 105 to simultaneously drive both drive blades 202, 203 downward. However, the blockader 201, which is located below the primary drive blade 202, prevents the primary drive blade 202 from moving all the way downward. Since the drive blade selector 105 is not at the location where the primary drive blade 202 is aligned with the opening of the drive blade selector 105, the primary drive blade 202 is thus secured between the drive blade selector 105 and the blockader 201. Consequently, the cover 109 cannot be completely depressed down. With such a situation, a user is reminded to confirm whether the staple selector 104 and the drive blade selector 105 are properly set in desired locations.

On the other hand, without the safe mode described, when the staple selector 104 and the drive blade selector 105 are set at locations as mentioned above. Depressing downward the cover 109 causes both the primary drive blade 202 and the secondary drive blade 203 to simultaneously strike the secondary staples 61. Consequently, breakdown of the stapler 10 results.

Figure 10:
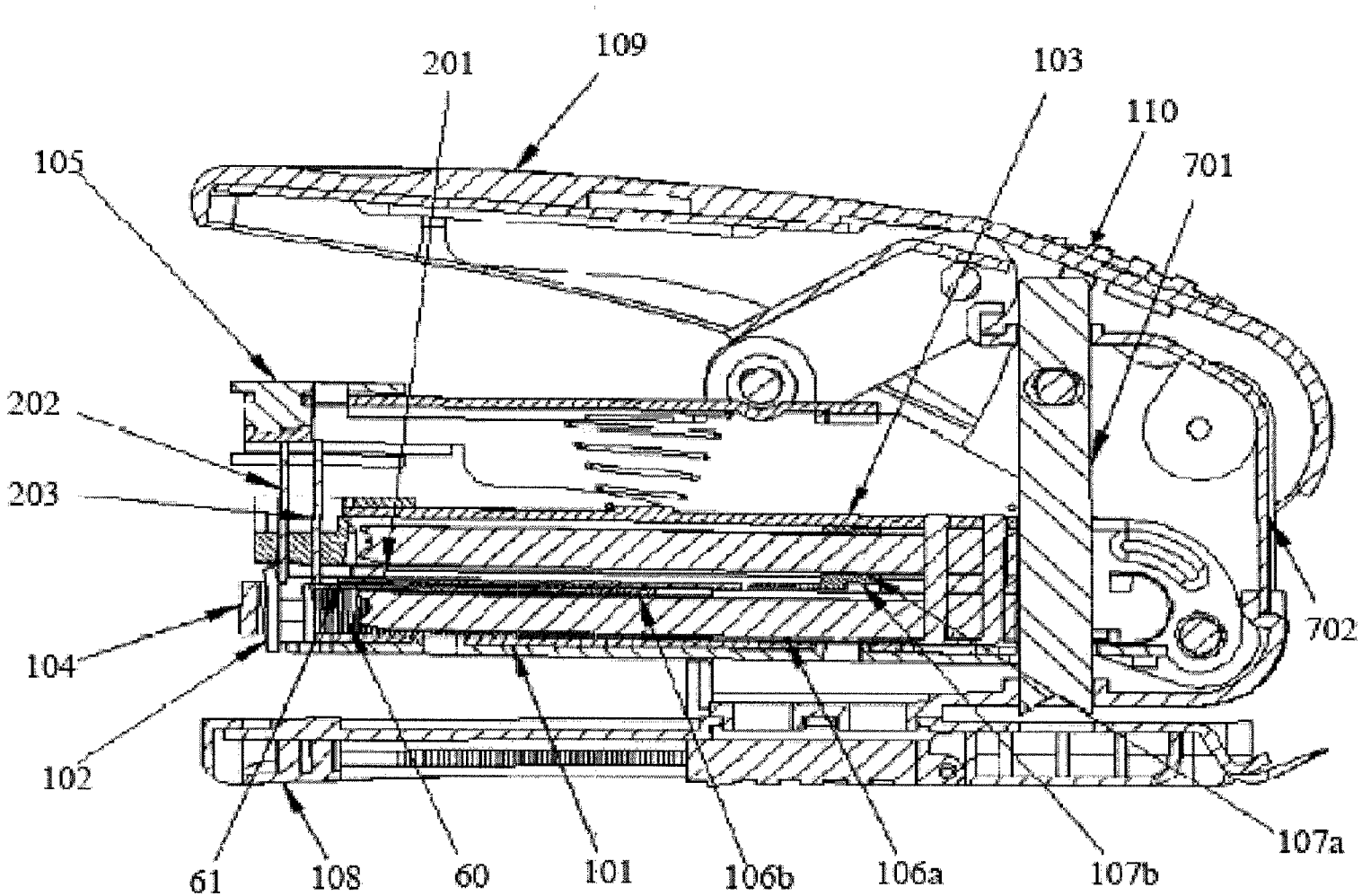
FIG. 10 is a side elevational view, in sectioned form, illustrating a perforation mode of the stapler of the present invention.

Referring to FIG. 10, a perforation or punching mode of the stapler 10 according to the present invention will be described. The perforation mode is used for punching or perforating documents. With the staple selector 104 is set in the engaged position and forcing the secondary staples 61 rearwards to locate behind the drive blades 202, 203 and the blockader 201 similarly located behind the drive blades 202, 203, and the drive blade selector 105 is set in the location where the primary drive blade 202 is aligned with the opening of the drive blade selector 105 and the drive blade selector 105 is coupled to the secondary drive blade 203. Therefore, the primary drive blade 202 is located above the first one of the primary staples 60.

Figure 11:
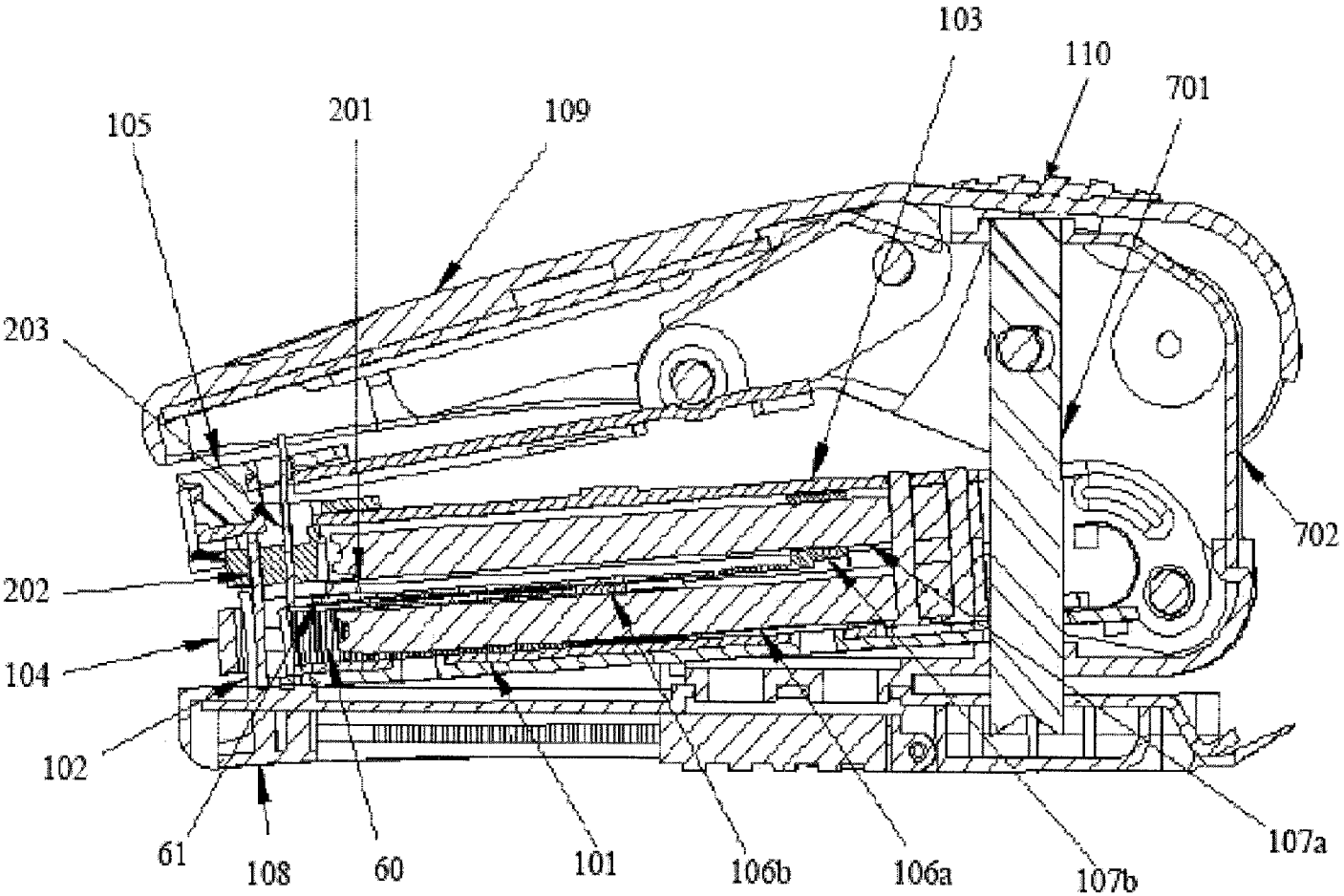
FIG. 11 is a side elevational view, in sectioned form, illustrating the operation of perforation carried out with the stapler of the present invention.

FIG. 11 illustrates the perforating operation of the stapler 10 according to the present invention. With the staple selector 104 and the drive blade selector 105 set at the locations shown in FIG. 10, depressing the cover 109 causes the drive blade selector 105 to move downward, and the primary drive blade 202 extends into the opening of the drive blade selector 105; and the secondary drive blade 203 is moved downward by the drive blade selector 105 into the space between the front walls of the primary staple magazine 101 and the secondary staple magazine 102. Thus, both the primary drive blade 202 and the secondary drive blade 203 carry out no staple striking operation.

A perforation bar 701 is arranged in a rear portion of the stapler 10 and connected a bracket 702, which is coupled to the cover 109. Thus, depression of the cover 109 causes downward movement of the perforation bar 701 to perform the perforating operation. The punched paper scrapes are collected in the removable cover 505.

Figure 12:
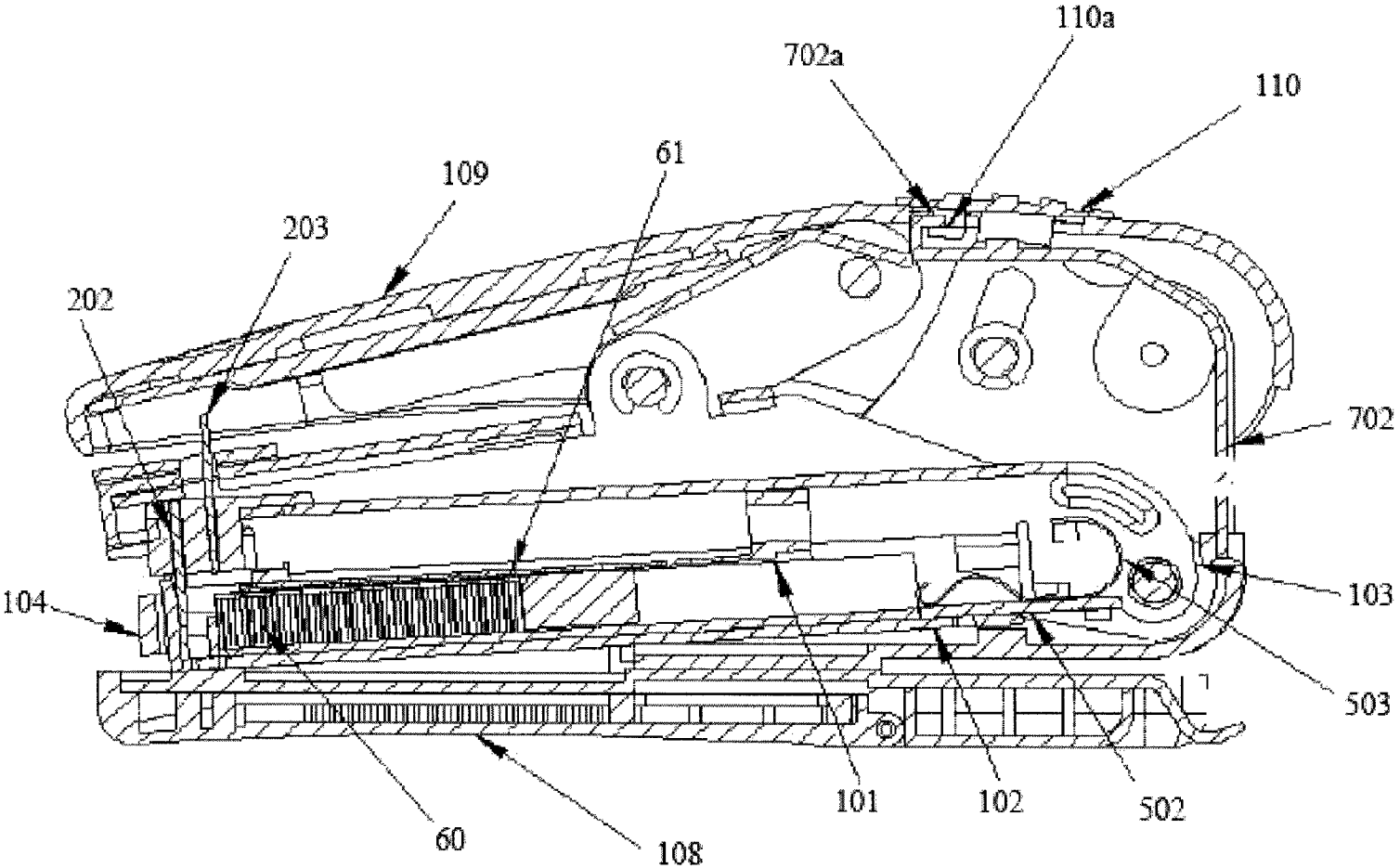
FIG. 12 is a side elevational view, in sectioned form, illustrating a storage mode of the stapler of the present invention.

FIG. 12 illustrates a storage mode of the stapler 10 according to the present invention. The storage mode is used for collapsing the stapler 10 to a compact and closed status for conveniently carrying away. The staple selector 104 and the drive blade selector 105 are set in the locations as the perforation mode shown in FIG. 10. And the cover 109 is depressed down. The switch 110 is then moved toward the front of the cover 109 to have a first barb 110*a*, which is formed on the switch 110, to engage a second counterpart barb 702*a* that is formed on the bracket 702. As a result, the cover 109 is closed down to the drive blade selector 105 and the stapler 10 can be closed to realize the storage mode.

FIG. 13 illustrates reloading of staples for the stapler 10 according to the present invention. In both the primary and secondary staple modes mentioned above, the primary staple magazine 101 and the secondary staple magazine 102 can keep immoveable by the crooks 502 with the resilient plate 503 being deformed and building therein potential energy. Under this condition, to reload the stapler 10 with the primary staples 60 and/or the secondary staples 61, it only need to actuate the release button 504 to allow the crooks 502 to release the staple carrier structure that is comprised of the primary staple magazine 101 and the secondary staple magazine 102. At the same time, the resilient plate 503 urges the staple carrier structure, namely the primary staple magazine 101 and the secondary staple magazine 102, out of the stapler 10. After the reloading of the primary staples 60 and/or the secondary staples 61 has done, the staple carrier structure and thus the staple magazine 101 and the secondary staple magazine 102 are moved back into the stapler 10 and secured again by the crooks 502.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A stapler comprising:

a base comprising a perforation bar arranged in a rear portion the stapler to selectively perform perforating operation;

a magazine rack mounted on the base;

a primary staple magazine receiving and containing primary staples, the primary staple magazine comprising a primary staple pusher to continuously forcing the primary staples forward to a front end portion of the primary staple magazine;

a secondary staple magazine arranging outboard and substantially surrounding the primary staple magazine and fixed to the primary staple magazine, the secondary staple magazine receiving and containing secondary staples therein, the secondary staple magazine comprising a secondary staple pusher to continuously forcing the secondary staples forward to a front end portion of the secondary staple magazine, the second staple magazine being slidably received in and retained by the magazine rack;

a drive blade fillister arranged at a front end of the magazine rack and movably supporting primary and second drive blades;

a staple selector mounted to the front of the secondary staple magazine and movable between first and second positions for selecting the primary and secondary staples;

a drive blade selector arranged above the front end portions of the primary staple magazine and secondary staple magazine for selectively driving the primary and secondary drive blades toward the primary and secondary staples, respectively; and a cover arranged above the base and the drive blade selector and carrying the perforation bar and movable to depressing the perforation bar and the drive blade selector to selectively carry out the perforation operation and selectively driving the primary and secondary drive blades.

2. The stapler as claimed in claim 1, wherein the secondary staple magazine has opposite side walls forming opposite flange bars for slidable engagement with the magazine rack.

3. The stapler as claimed in claim 1 further comprising a blockader that is movable with respect to secondary staple magazine.

4. The stapler as claimed in claim 1, wherein the cover comprises a switch having a first bar and wherein the base is provided with a second barb engageable with the first barb to secure the cover in the storage mode.

5. The stapler as claimed in claim 1, wherein the perforation bar is mounted to a bracket that is mounted to the base.

6. The stapler as claimed in claim 1, wherein the base comprises a staple magazine retainer to releasably retain the primary staple magazine and the secondary staple magazine in the stapler.

7. The stapler as claimed in claim 1, wherein the base comprises a movable cover to store scraps of paper generated by the perforating operation, the movable cover being openable to discharge the scraps.

8. The stapler as claimed in claim 1, wherein the base comprises a positioner to ensure consistent distance of binding.

* * * * *